US006056167A

United States Patent [19]

Dorow et al.

[11] Patent Number: 6,056,167

[45] **Date of Patent: *May 2, 2000**

[54] PRESSURE SPRAYER

[75] Inventors: Glen Dorow, Glencoe; Steve Hill, Chesterfield; Dean Maune, Washington, all of Mo.

[73] Assignee: United Industries Corporation, St. Louis, Mo.

[ * ] Notice: This patent is subject to a terminal disclaimer.

[21] Appl. No.: 08/934,459

[22] Filed: Sep. 19, 1997

Related U.S. Application Data

[63] Continuation of application No. 08/418,517, Apr. 7, 1995, Pat. No. 5,669,532.

[51] Int. Cl.[7] ..... B65D 83/00

[52] U.S. Cl. ..... 222/401; 222/153.13; 222/402

[58] Field of Search ..... 222/396, 397, 222/401, 385, 529, 384, 530, 153.06, 468, 153.13, 402; 417/284, 553; 251/4; 239/355, 359, 360

[56] References Cited

U.S. PATENT DOCUMENTS

| | | | |
|---|---|---|---|
| 1,396,494 | 11/1921 | Wright | 417/284 |
| 1,863,754 | 6/1932 | Lissauer et al. | 417/553 |
| 2,985,359 | 5/1961 | Hanje | 222/401 |
| 3,251,514 | 5/1966 | Speicher | 222/468 |
| 3,367,540 | 2/1968 | Lehman | 222/153.06 |
| 5,299,917 | 4/1994 | Schultz | 417/553 |
| 5,669,532 | 9/1997 | Dorow et al. | 222/401 |

FOREIGN PATENT DOCUMENTS

| | | | |
|---|---|---|---|
| 96466 | 12/1960 | Netherlands | 417/553 |
| 308083 | 9/1955 | Switzerland | 417/553 |

*Primary Examiner*—Philippe Derakshani
*Attorney, Agent, or Firm*—Fellers, Snider, Blankenship, Bailey & Tippens, P.C.

[57] ABSTRACT

A non-round pressure sprayer unit for dispensing liquids from a closed container including a pressure pump, tube/hose connection, and applicator wand. The pressure pump mechanism further includes a pump housing sealingly insertable in the pressure sprayer bottle, a plunger for reciprocating within the housing with an upstroke and a downstroke, and a pump piston at the lower end of the plunger. The pump piston includes a bottom closure for closing the lower end of the pump housing when the piston is lowered on the downstroke and capable of opening the lower end of the pump housing when the piston is raised in the upstroke. A pump seal seals the piston and the inner wall of the pump housing when the piston is on its downstroke but becomes unsealed on the upstroke of the piston.

10 Claims, 11 Drawing Sheets

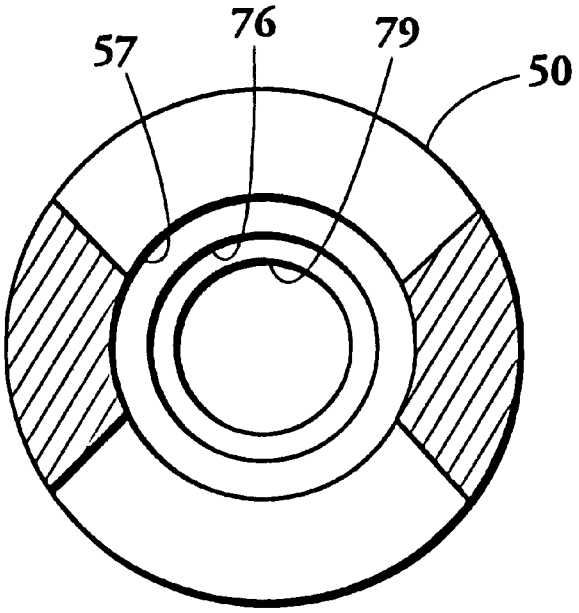
*Fig.. 15*
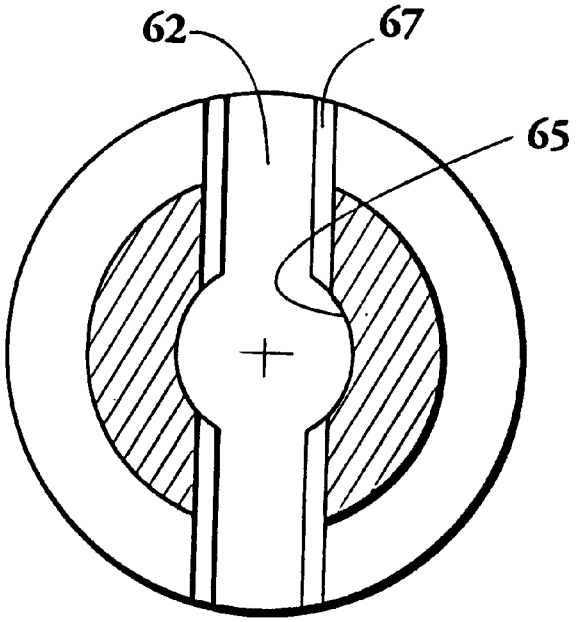
*Fig. 16*

PRESSURE SPRAYER

This is a continuation of application, Ser. No. 08/418,517, filed on Apr. 7, 1995, now U.S. Pat. No. 5,669,532, issued on Sep. 23, 1997.

BACKGROUND OF THE INVENTION

This invention relates to a home and garden-type sprayer for spraying liquids such as weed killers onto unwanted plants, for example.

There are basically two common types of spray containers for home and garden general use. In one system the weed killer, or whatever liquid that is to be sprayed, is placed in a plastic container. An opening is provided in the top of the container and a hand operated trigger style pump is inserted through this opening and locked in place while the container is being shipped. The container is not pressurized. The pump is finger operated and provides a dispensing of the contained liquid onto directed vegetation. However, this system is only suitable for very small amounts of spraying in as much as the liquid in the container is dispersed solely by the finger operated pump, which is limited by the finger getting tired rather rapidly.

Another common spraying system for homes and gardens includes round metallic or plastic tanks which are provided with a hand pump which is screwed into an opening at the top of the tank. There is also a hose which extends sealingly out through another hole in the tank to a valve wand for spraying. In this system the tanks are sold dry, that is, no liquids in them. When it is desired to use the tank, the pump is withdrawn, and the desired liquid or chemical is poured into the tank. The pump is reinserted into the tank and tightened to form a seal. The plunger of the pump is then reciprocated to build up the desired pressure. Thereafter the valve on the hose is released to direct chemical onto the selected plant.

An explanation of a typical hand pump container is shown in U.S. Pat. No. 5,373,973, issued Dec. 20, 1994.

SUMMARY OF THE INVENTION

This is a non-round pressure sprayer unit for dispensing liquids such as weed killers from a closed container. At the factory each unit is filled with the desired amount of a selected liquid. The pressure pump is locked in closed position so that liquids cannot be lost while the units are being shipped or in storage. The container or bottle has two openings at the top. A pressure pump is inserted through one. The other is for a hose connected to a wand and extending into the bottle. Each of these openings are closed at the factory and remain so until ready for use. A removable cap covers the one opening, and the pressure pump closes the other. The hose and wand are shipped in a plastic bag connected to the outer wall of the bottle. A tab connecting the pump handle to the bottle locks the plunger of the pump in its down position.

When one is ready to use the pressure sprayer, all one has to do is remove the cap from the wand hose entry hole, insert the wand hose through a hose connector or coupling cap and into the bottle or container. The connector cap is of a conventional structure such that when the cap is tightened, the hose will be sealed to the cap, and thus will not leak. The connector cap is then tightened onto the connector opening. Next, the tab holding the plunger in locked, closed position is broken, and the pressure sprayer is ready for operation. The plunger is lifted several times, e.g. ten to fifteen times and pushed back down to build up pressure within the bottle.

The device is now ready to be used. All one has to do is release the valve button on the wand and point the wand at the vegetation which is meant to be killed or treated.

A novel pressure pump makes the pressure sprayer unit successful. There are several unique features about the pressure pump. The plunger is connected to a piston which is inside a cylindrical housing. When the plunger is at its lower position (and in the shipping mode), there is a disk-like closure member at the bottom of the piston and which has a lower shoulder. This closure member completely closes the lower end of the housing. Against this lower shoulder is an O-ring closure seal which seals against the inner wall of the pump housing. When in this position, fluid cannot escape upwardly through the pump. The pump housing has a main section of a diameter $D_1$ and a lower section of smaller diameter having a diameter $D_2$. This O-ring closure seal is against the smaller diameter of the internal wall of the housing. In operation, when the plunger is lifted, the disk is also raised, but the seal can no longer seal because of the larger size diameter of the housing.

The pump piston is provided with a second downwardly facing shoulder positioned in the larger portion of the housing which is provided with an O-ring seal which seals the piston to the housing. The piston has a diverging truncated section extending downwardly from the shoulder such that when the piston is raised the seal no longer seals. The O-ring seal is carried up by another shoulder at the lower end of the truncated section. Thus, as the piston is raised, air can pass to the underside of the piston. When the piston rod gets to the top, it is then pushed back down. As it is pushed down, the pump seal is again sealed when the second downwardly facing shoulder contacts it on the downstroke. Then the piston acts as a pump piston to force air out through the check valve in the bottom of the housing to pressurize the head space of the container.

In the center portion of the hollow pump piston is a pressure relief valve so that if the pressure is attempted to be built up too high, it will be relieved and thus prevents overpressuring of the container.

It is thus an object of this invention to provide a non-round bottle with a pressure pump which has means to provide for safe shipping of liquids therein and also for easy conversion to a pressure sprayer unit.

It is a still further object of this invention to provide a valving arrangement in connection with a piston or pressure pump whereby the fluid can be stored in the container while it is being shipped without being spilled and which can be released by simple operation of the air pump.

These and other objects will become apparent from the following description taken in conjunction with the drawings, in which:

BRIEF DESCRIPTION OF THE DRAWINGS

FIG. 15 is taken along the line 15—15 of FIG. 12.

FIG. 16 is a view taken along the line 16—16 of FIG. 12.

DESCRIPTION OF THE PREFERRED EMBODIMENTS

Figure 1:
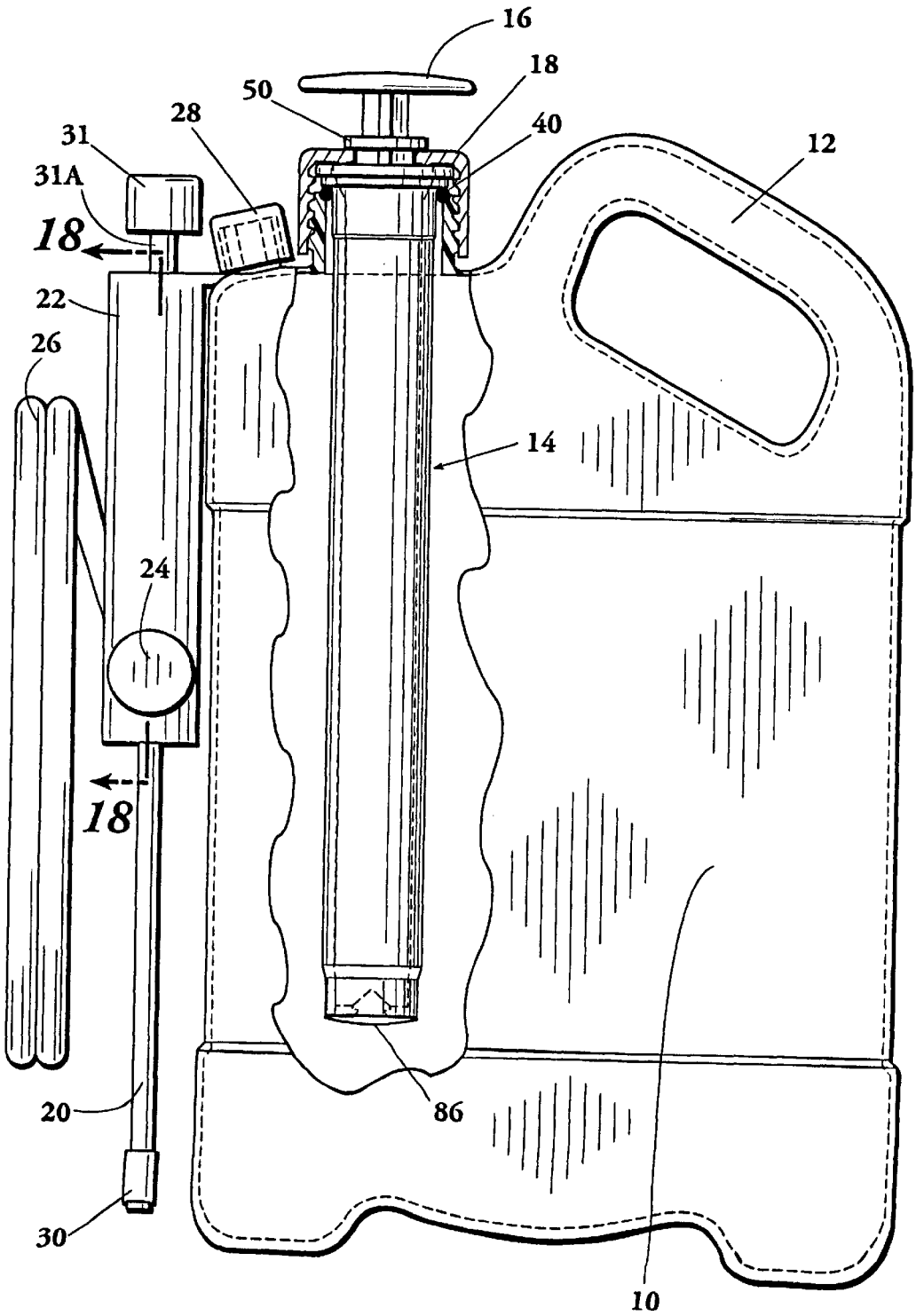
FIG. 1 is a side elevation view of the pressure sprayer unit of this invention partly cut away to show the pressure pump.

FIG. 1 illustrates a side view of a pressure sprayer unit having a pressure container or bottle 10 having hollow handle 12. In the preferred embodiment, bottle 10 is a non-round, F-style bottle constructed of high density polyethylene (HDPE) which weights approximately 400 grams. High density polyethylene is particularly suitable for the construction of the bottle because of its strength since bottle 10 becomes a pressure vessel. When pressurized, bottle 10 will be subject to pressures of between 10 psi and 15 psi. A pump unit 14 is inserted through a hole in the top of bottle 10 and is held in position by cap connector 18. As seen more clearly in FIG. 3, this connector 18 includes a cap 17 having internal threads 38 mating with a threaded section 36 integral with top 34 of the body of bottle 10. A shoulder 42 forms a seat on the upper end of the pump cylinder 46. A seat 44 is provided at the upper end of threaded section 36. There is a seal 40 between seat 42 and seat 44. Pump 14 has a pump handle 16 and a check valve 86 at the bottom. The check valve 86 will be explained in more detail in relation to the other figures, especially FIGS. 3, 4, and 5.

Figure 2:
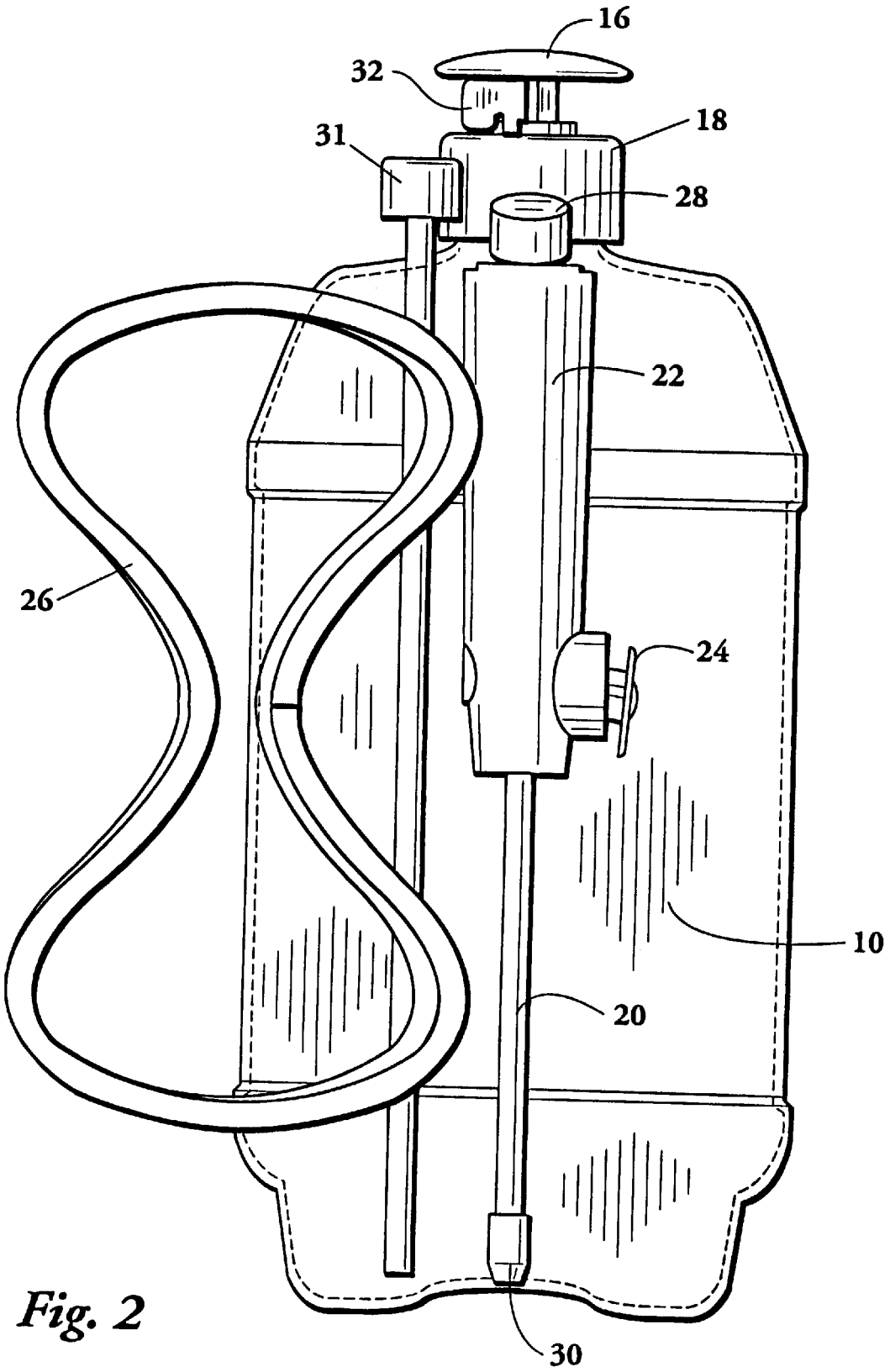
FIG. 2 is a side view of the pressure sprayer unit of FIG. 1.

As shown in FIG. 2, pump handle 16 is locked in position by break-away tab 32, which connects the handle to the connector body 18. This is an easily breakable tab which can be broken with the thumb when it is desired to use the device but prevents operation of the pump during shipping.

There is also shown a wand hose cap 31. A cap 28 closes a second opening in the top of the container 10. A hose 26 is attached to the bottle 10 during shipment. There is a handle 22 having a button 24 and an extension tube 20 with nozzle 30.

Operation of the device shown in FIGS. 1 and 2 is relatively easy. If one desires to use it, one would remove cap 28. One end of dip tube 31A is pushed down through the passage in a replacement cap 31 connectable to the opening uncovered by removing cap 28. After a sufficient amount of hose is pushed through the replacement cap 31 into the bottle 10, the replacement cap 31 is screwed on the threads from whence cap 28 was removed. The replacement cap is a type which as it is tightened forms a seal with hose 26 that was pushed into it. The other end of hose 26 is friction fit to extension tube 20 inside wand 22 so that hose 26 and extension tube 20 are sealed together. Various conventional means may be used to make these connections.

Figure 17:
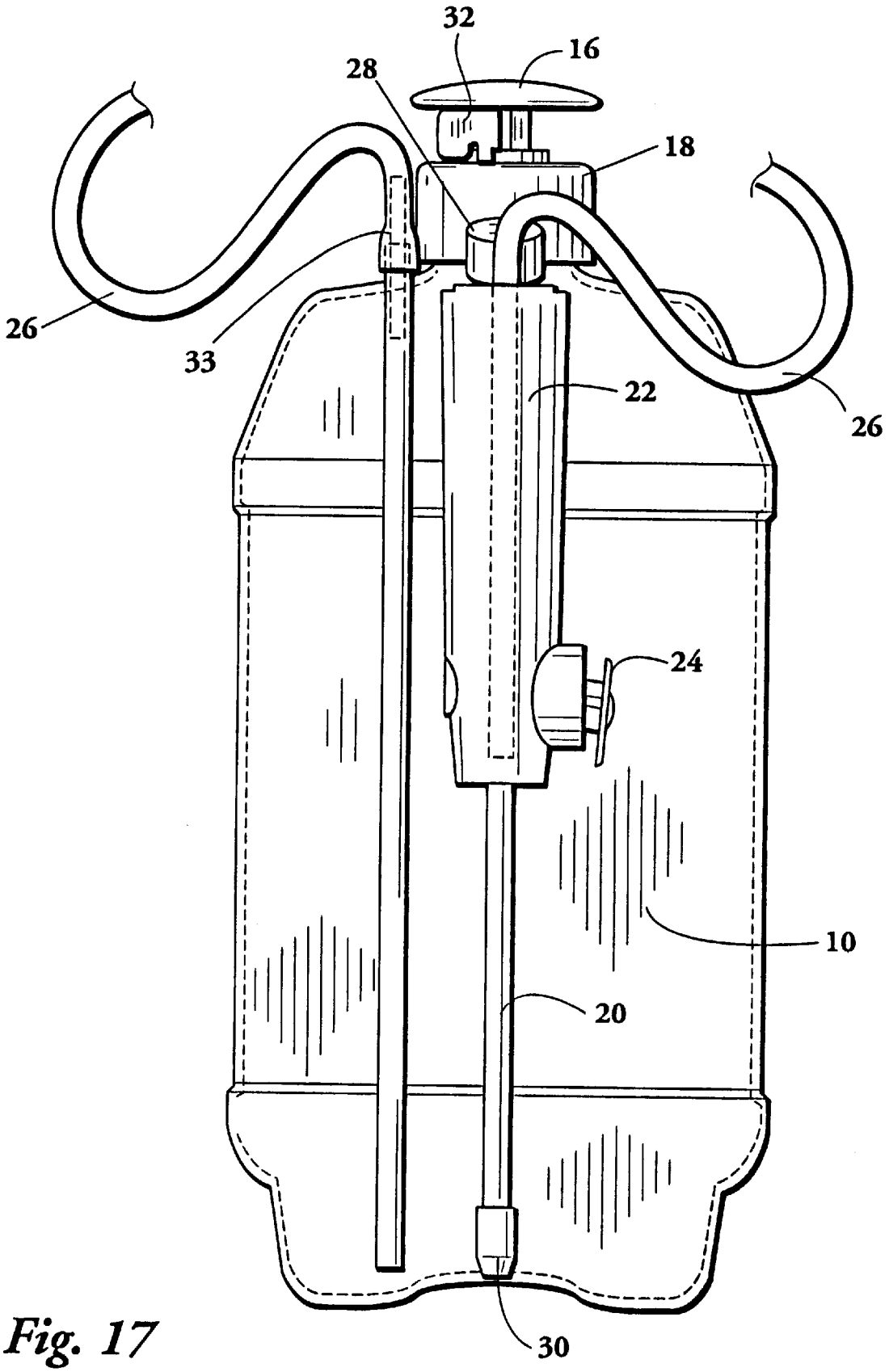
FIG. 17 is a side view of the pressure sprayer unit of FIG. 1 showing the hose connected to the dip tube on its one end and the wand at its other end.

FIG. 17 is a side view of the pressure pump unit of FIG. 1 showing hose 26 connected to tube 31A on its one end and showing its other end extending inside wand 22. A support element 33 is inserted inside dip tube 31A and hose 26 is brought down over it and press fit onto dip tube 31A. Support element 33 is a piece of semi-rigid tubing which is more rigid than hose 26 but less rigid than dip tube 31A. Support element 33 extends through the joint between hose 26 and dip tube 31A inside cap 31 (of FIG. 1) and acts to prevent hose 26 from becoming kinked flat or twisted so as to restrict or prohibit the flow of fluid. During shipment of the pressure pump unit, dip tube 31A (including wand hose cap 31 of FIG. 1), hose 26, support element 33, and wand 22 are assembled as shown in FIG. 17 and placed in a plastic bag, which is fixed to bottle 10. One then breaks tab 32, and the unit is ready for operation.

Figure 18:
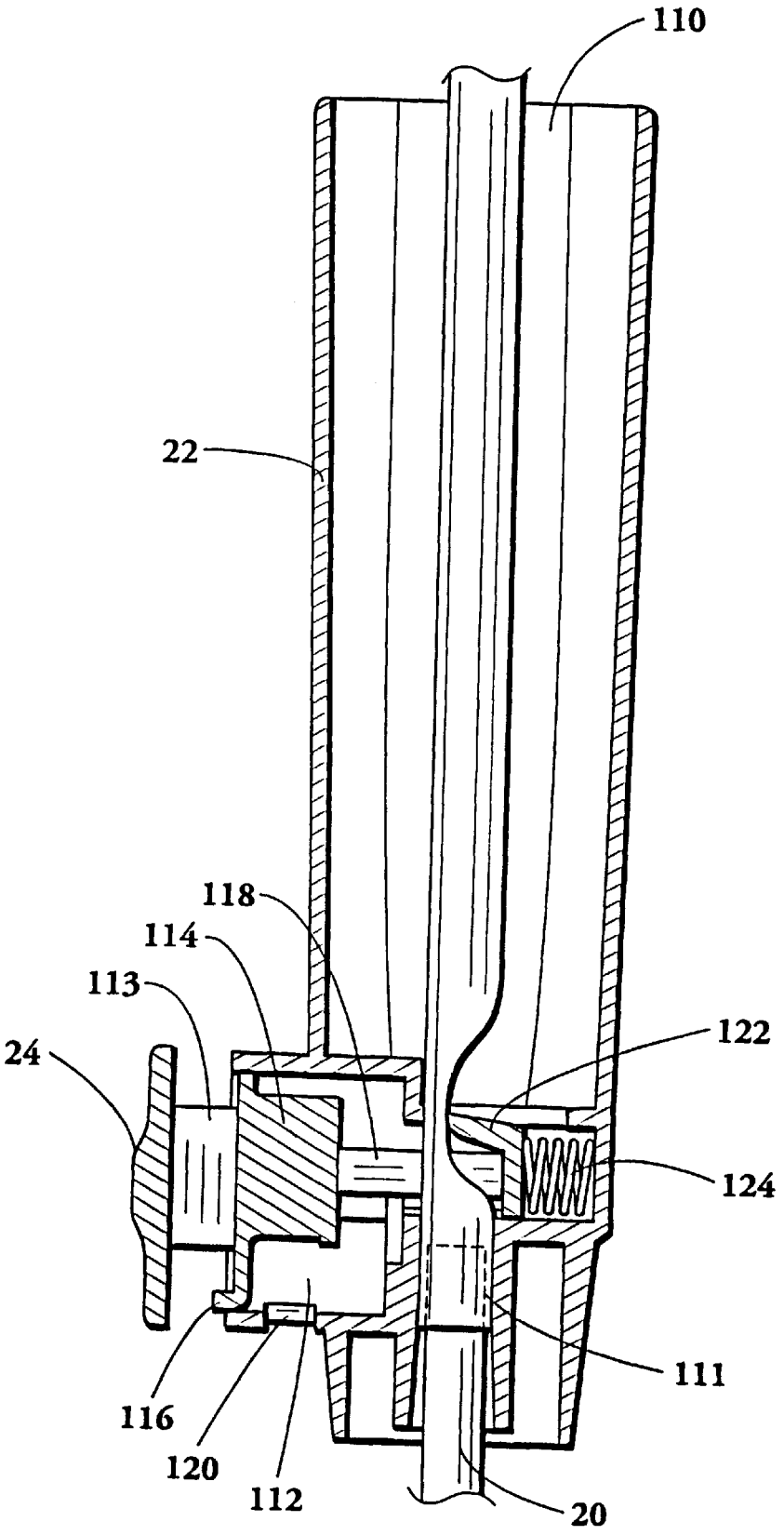
FIG. 18 shows in cross-section the wand of the pressure sprayer unit.

FIG. 18 is a cross-section of the wand showing its internal mechanism. The body of handle 22 includes a hollow cavity 110 along its length into which hose 26 is inserted. Tube 20 is friction fit onto hose 26 in the area identified as 111. The portion of tube 20 fit into hose 26 is shown in phantom. Wand 22 further includes a metering mechanism in order to control the flow of fluid. Handle 22 also includes a cavity 112 through which the metering mechanism extends. The metering mechanism includes button 24, spacer 113, flow block 114, depression bar 118, pinch valve 122, and spring 124. Button 24 is designed to be depressed by the thumb of the user's hand in order to control the flow of fluid through the wand. Spacer 113 connects button 24 to flow block 114 so that when button 24 is depressed, flow block 114 is forced downward within cavity 112. A depression bar 118 connects flow block 114 to a pinch valve 122. A spring 124 is positioned within handle 22 to bias pinch valve 122 upwardly.

Pinch valve 122 is L-shaped with horizontal and vertical extensions. Depression bar 118 forces against the horizontal extension of pinch valve 122. The vertical extension of pinch valve 122 contacts hose 26. Since hose 26 is flexible, pinch valve 122 pinches or crimps hose 26 against the inside wall of handle 22 which defines cavity 112. When pinch valve 122 crimps hose 26, the flow of fluid through hose 26 is restricted. Spring 124 maintains pressure against the underside of the horizontal extension of pinch valve 122.

In operation, to dispense fluid through the wand, button 24 is depressed by the thumb of the user. Depression of button 24 depresses spacer 113 and flow block 114 inside cavity 112. Flow block 114 includes a tab 116 for insertion into a hole 120 can be considered a stop means which in handle 22. Engagement of tab 116 into hole 120 allows continuous flow of fluid without requiring the user to maintain constant pressure on button 24.

As flow block 114 is depressed within cavity 112, depression bar 118 contacts pinch valve 122, forcing it downward against spring 124. When pinch valve 122 is forced downward, flexible hose 26 is no longer crimped or pinched so that fluid under pressure flows through it and out into the environment through tube 20.

Figure 3:
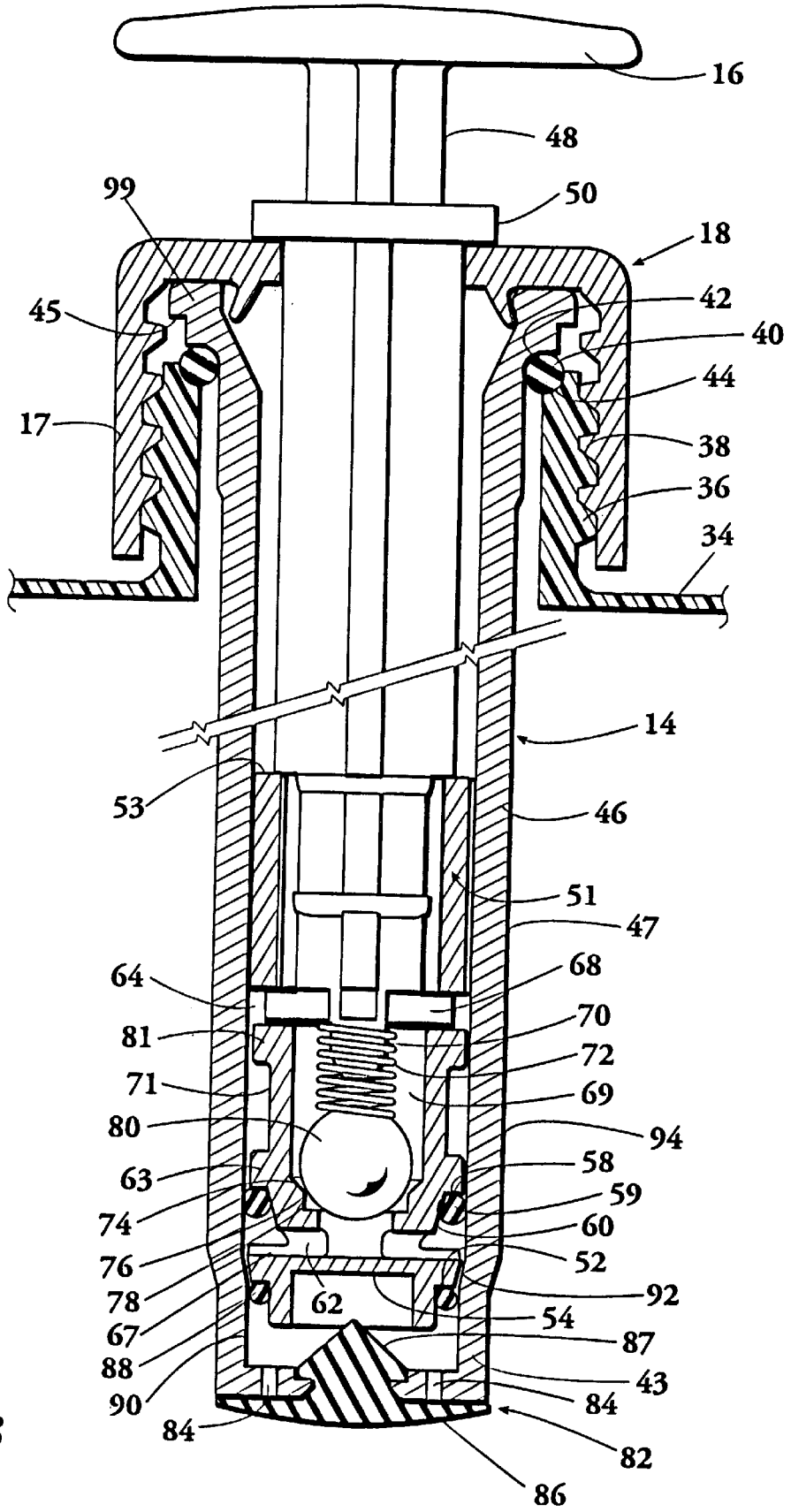
FIG. 3 is a section view of the pressure pump.
Figure 8:
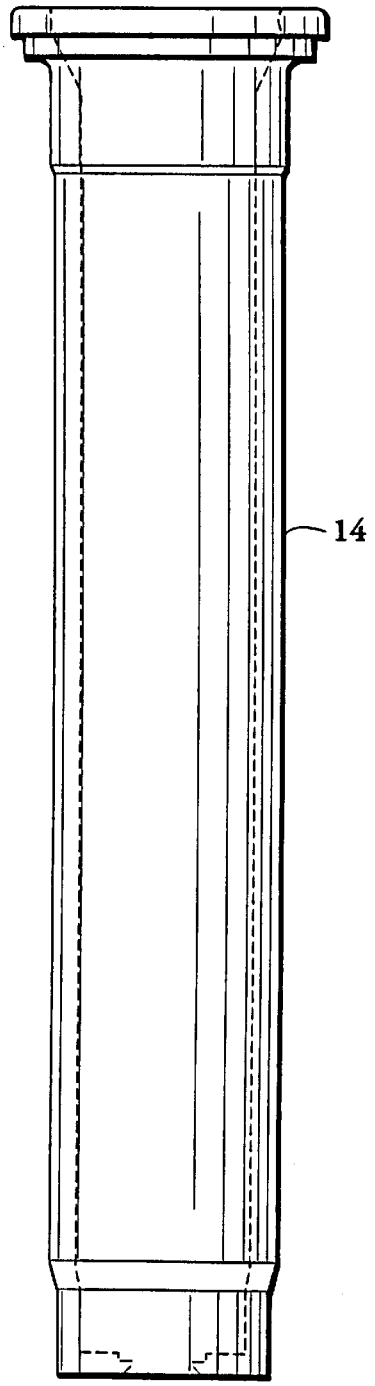
FIG. 8 is a full face view of the cylinder of the pump of FIG. 5.

A description of novel pressure pump 14 will now be made. Attention is next directed to FIG. 3 which has a pump housing or cylinder 46 which is also shown in isolated form in FIGS. 6 and 8. The middle or main portion 47 of the cylinder has a diameter $D_1$, the cylinder 46 converges at the lower end into section 43 which has an inside diameter $D_2$, which is less than $D_1$. The lower end of section 43 is provided with an opening 15 which is enlarged at the upper end of the opening 15 to have an annular shoulder 19. A plurality of ports 84 pass through the end just outside the opening 15. In this opening 17, a check valve 82 has flexible disk 86 and a holding head 87, as shown in FIG. 3. This disk can be any material that is resilient and capable of withstanding any chemical action of the stored liquid and will function to open the port 84 as pressure builds up in the inside of section 43 of the cylinder. The disk 86 must also resist upward flow of liquid through port 84.

Figure 9:
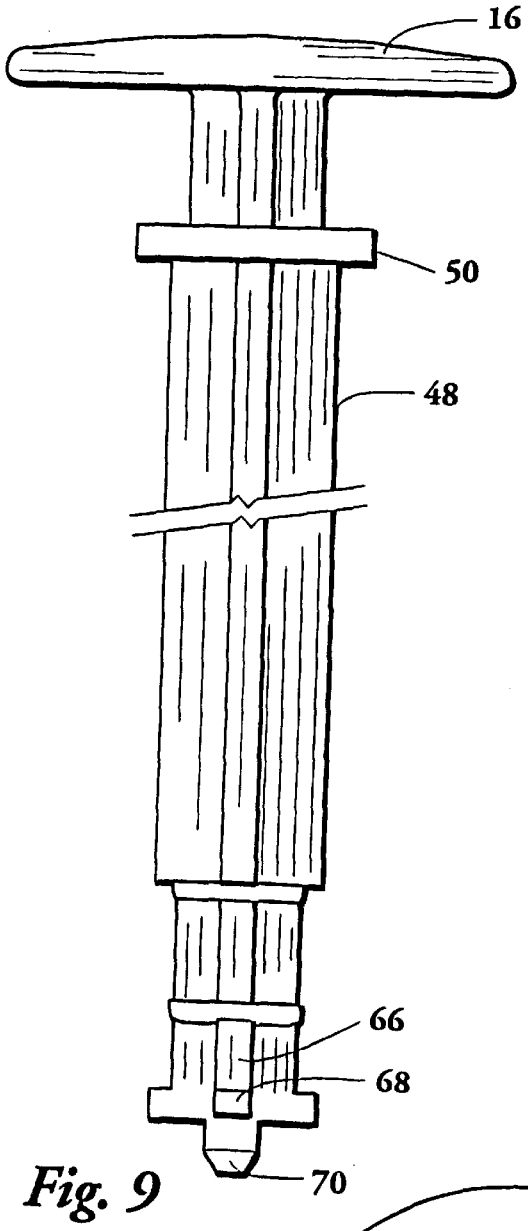
FIG. 9 shows the plunger and handle of the pump unit of FIG. 5.
Figure 10:
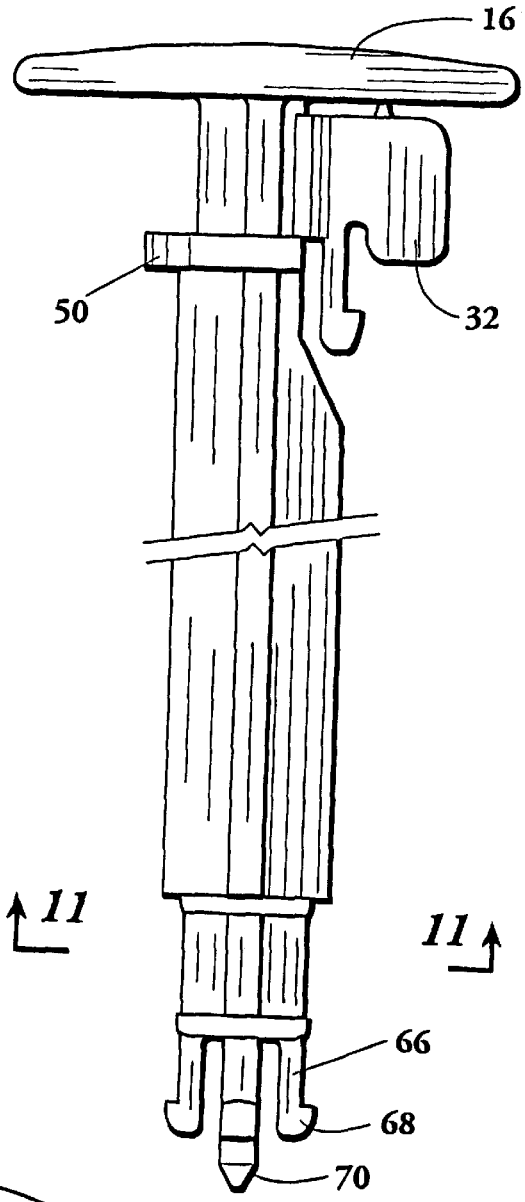
FIG. 10 is similar to FIG. 9 except that the plunger has been rotated 90½.
Figure 11:
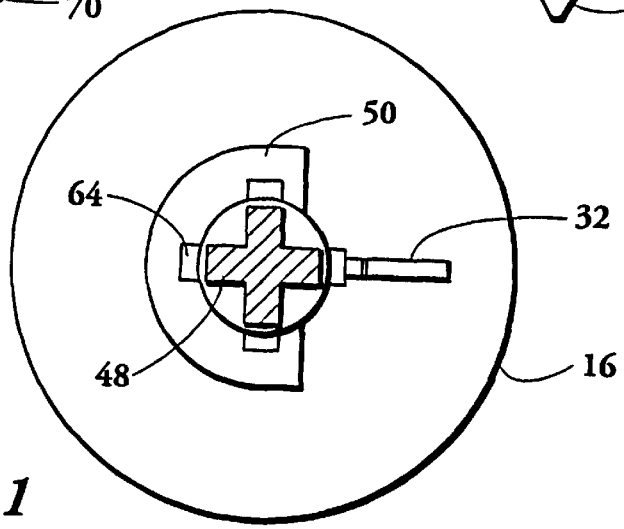
FIG. 11 is a view taken along the line 11—11 of FIG. 10.
Figure 14:
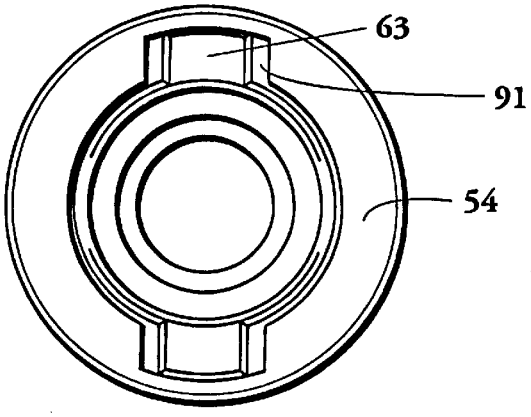
FIG. 14 is a top view of FIG. 12.

There is a plunger 48 with handle 16 which has a shoulder 50 outside cap 18. This plunger 48 is shown in isolated form in FIGS. 9, 10, and 11. The lower end of plunger 48 is provided with a plurality of arms 66 having lugs 68 thereon. The material of the plunger is resilient so that the arms 66 can be squeezed in toward each other; but when the pressure is released, will expand to the position shown in FIGS. 9 and 10. As will be seen in FIG. 3, these extend into a slot 64 of the pump piston 51. The lower end of plunger 48 is provided with a knob or nose 70 which, when assembled, will act as a spring holder. Pump piston 51 is attached to the lower end of plunger 48. This pump piston 51 is shown in isolated views in FIGS. 12 and 13. This piston 51 is provided with slots 64 for receiving lugs 68 of the plunger. To assemble this, the arms 66 are squeezed together and inserted into the interior of pump piston 51. The plunger is then forced downwardly. When the lugs 68 reach slots 64, they expand out into the slots, and thus the plunger and the housing of the piston 51 are securely locked together. The plunger and piston could be a unit, but this is an easy way of manufacturing. The plunger is of lesser diameter than the diameter of the pump piston so that there is a shoulder 53 on the top of the piston. The size of the diameter of the pump cylinder piston 51 is of a size to conveniently move up and down in housing or cylinder 46 with a loose fit therein. The shoulder 53 helps prevent the pump plunger 48 from being pulled all the way out in operation.

Figure 6:
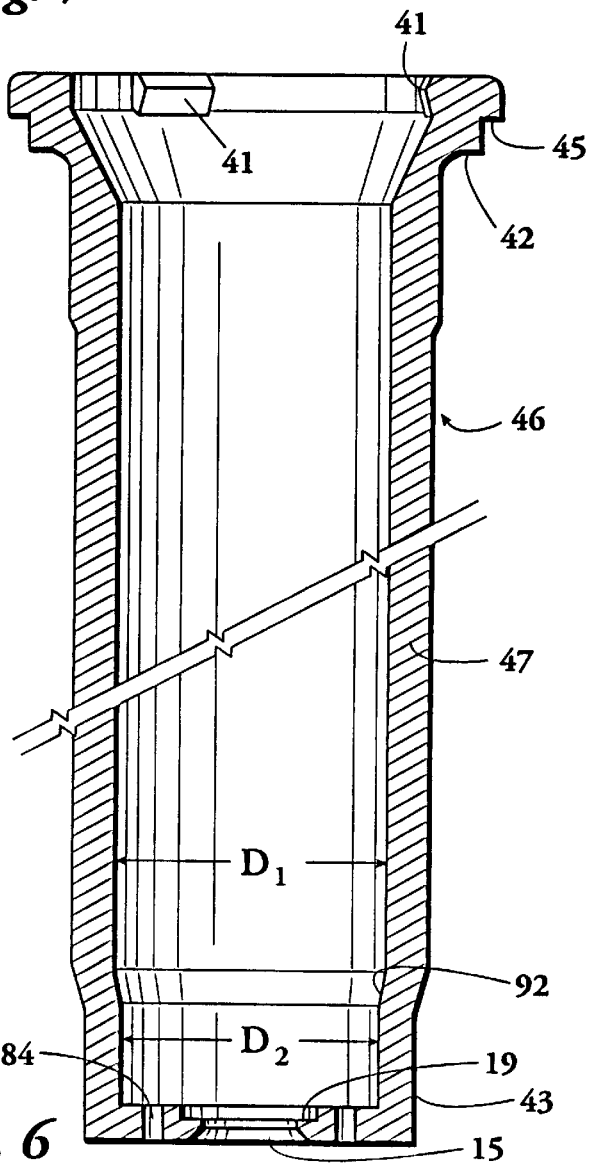
FIG. 6 shows in cross-section the cylinder of the pump unit of FIG. 5

Next shall be discussed safety means for preventing any chemicals from bottle 10 being lost through the pump during shipping or storage before use. The position shown in FIG. 3 is the position of the plunger when it is shipped. It is held in this lower position by a tab 32 (see FIG. 2). The transitory seal of that unit includes a disk-like member 54, a part of piston 51 whose outer periphery has a sloping shoulder 49 (see FIG. 13) which is slightly smaller than shoulder 92 of the cylinder 46 as shown in FIG. 6 but complementary thereto and forms an annular space. This annular space is big enough so when the O-ring 88 is not in use, when the pumping action starts, air to be compressed can flow through the annular space between the disk 54 and the housing 46. The lower side of the disk 54 is provided with an annular shoulder 52. A short cylinder stub 56, smaller than $D_2$, is made an integral part of the disk 54, and extends downwardly. O-ring seal 88 fits against the shoulder 52 and against the inner surface of housing section 43 as shown in FIG. 3 and acts as a bottom closure means. When the plunger is in the position shown in FIG. 3, no fluids can escape upwardly through the housing 46. This seal 88 and check valve 82, which will be discussed later, form double protection against leakage of the container liquid into the upper cylinder space.

Now will be discussed the pump seal mechanism so that when the plunger is pulled upwardly air can flow beneath the plunger and the housing inner wall; and when the plunger is forced downwardly, the seal between the piston and the inner wall of cylinder 46 will be effected so that, pressure can be built up beneath the plunger. In this regard, pump piston 51 has an intermediate or lower shoulder 58 which faces downwardly and is on the lower side of annular protrusion 63. The annular protrusion 63 is of sufficiently smaller diameter than the inside of the housing 46 so that air can flow freely therebetween when O-ring seal 59 becomes ineffective. There is a truncated member 60 extending downwardly from protrusion 63 to form shoulder 58 on lower side of protrusion 63. An O-ring 59 rests against shoulder 58 of the protrusion 63 and against the sloping shoulder 60. When in the position shown in FIG. 3, there is an effective seal formed between the bottom of the pump piston 50 and the internal wall of cylinder 46.

Figure 12:
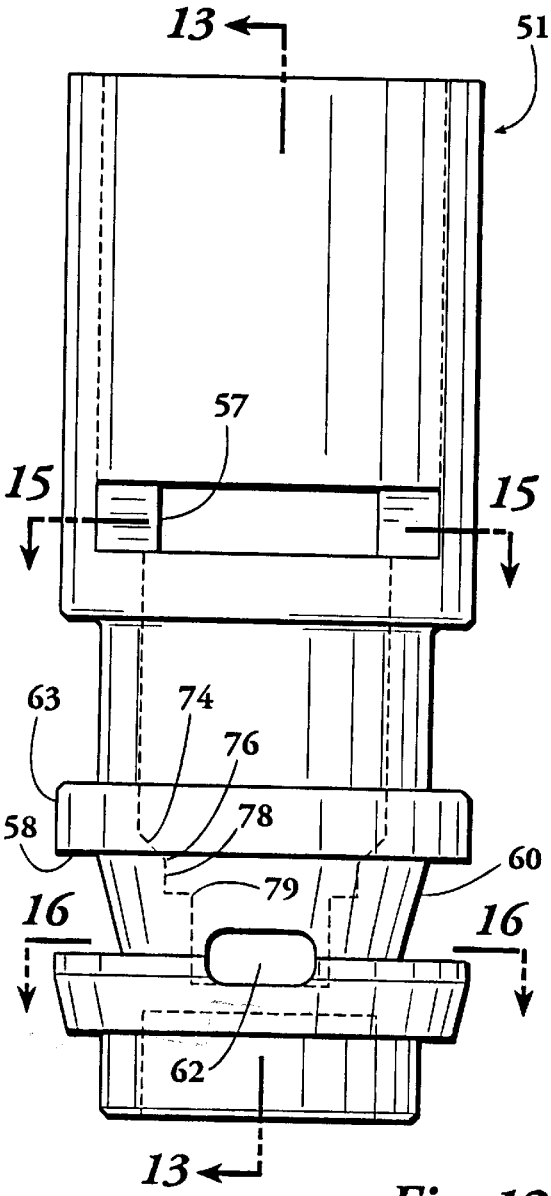
FIG. 12 is a full face view of the pump piston.
Figure 13:
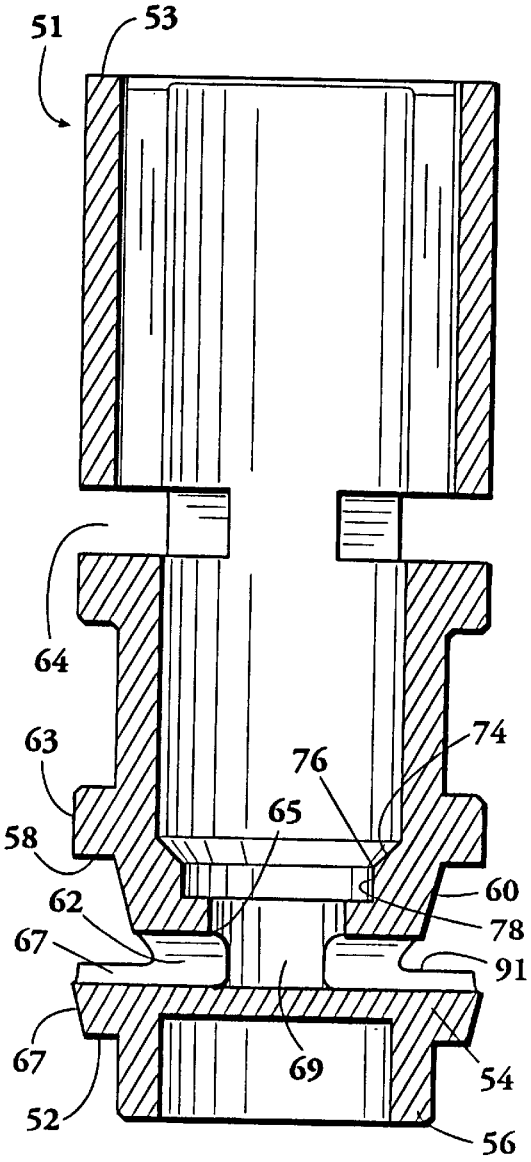
FIG. 13 is taken along the line 13—13 of FIG. 12.

As shown more clearly in FIGS. 12 and 13, there is a passage 62 between the interior 69 below slot 64 and the space beneath the lug protrusion 63. There is also a plurality of lateral openings or valleys 67 which extend from passage 62 to the outside of pump piston 57. Between the valleys are lands 91. The functions of these will be discussed and explained hereinafter.

A safety or relief valve will now be discussed in relation to the drawings. Shown in the drawings and especially FIGS. 3, 12, and 13, is an opening 62 out of the bottom of the mid section of the pump piston 51 from space 69. This includes a circular edge 79, a vertical shoulder 78, a sloping shoulder 74 with a circular edge 76 or valve seat between the vertical shoulder and the sloping shoulder. Attention is now directed specifically to FIG. 3 which shows a ball valve 80 which is forced downwardly against seat 76. A spring 72 extends upward and is held in position by nose 70 on the lower end of plunger. The lower end of spring 72 receives ball valve 80. The spring 72, ball 80, and seat 76 are designed so that the pump cannot build up excessive pressure. When a selected design pressure is reached, the valve 80 will open, and the pump will not be effective until the pressure is reduced to below its design level.

Attention is now directed to the way of sealing and securing the pump mechanism in the container or bottle 10. The top of container 10 is provided with a cylindrical opening which at the top 34 of the cylinder is provided with an opening which has a vertical threaded section 36. This section has a seat 44 to seat O-ring 40. The upper end of cylinder 46 has a flared section 99 which has an external seat 42. It is between the seat 42 and seat 44 that O-ring 40 is secured. Also provided is a cap connector 18 which has a vertical passage through which the plunger 58 can freely pass. The opening through which the plunger passes is smaller than the diameter of the shoulder 50 so that the plunger can only be pushed downwardly a selected distance. The cap connector 18 has threads 38 which threadably connect to threads 36. There is a flared extension 99 on the top of a cylinder 46 which has shoulders 45. This flared section 99 gives more support for the cap connector 18. All these parts just described are such that when the cap connector 18 is screwed firmly onto the threads 36, O-ring 40 forms a good and secure seal.

Figure 4:
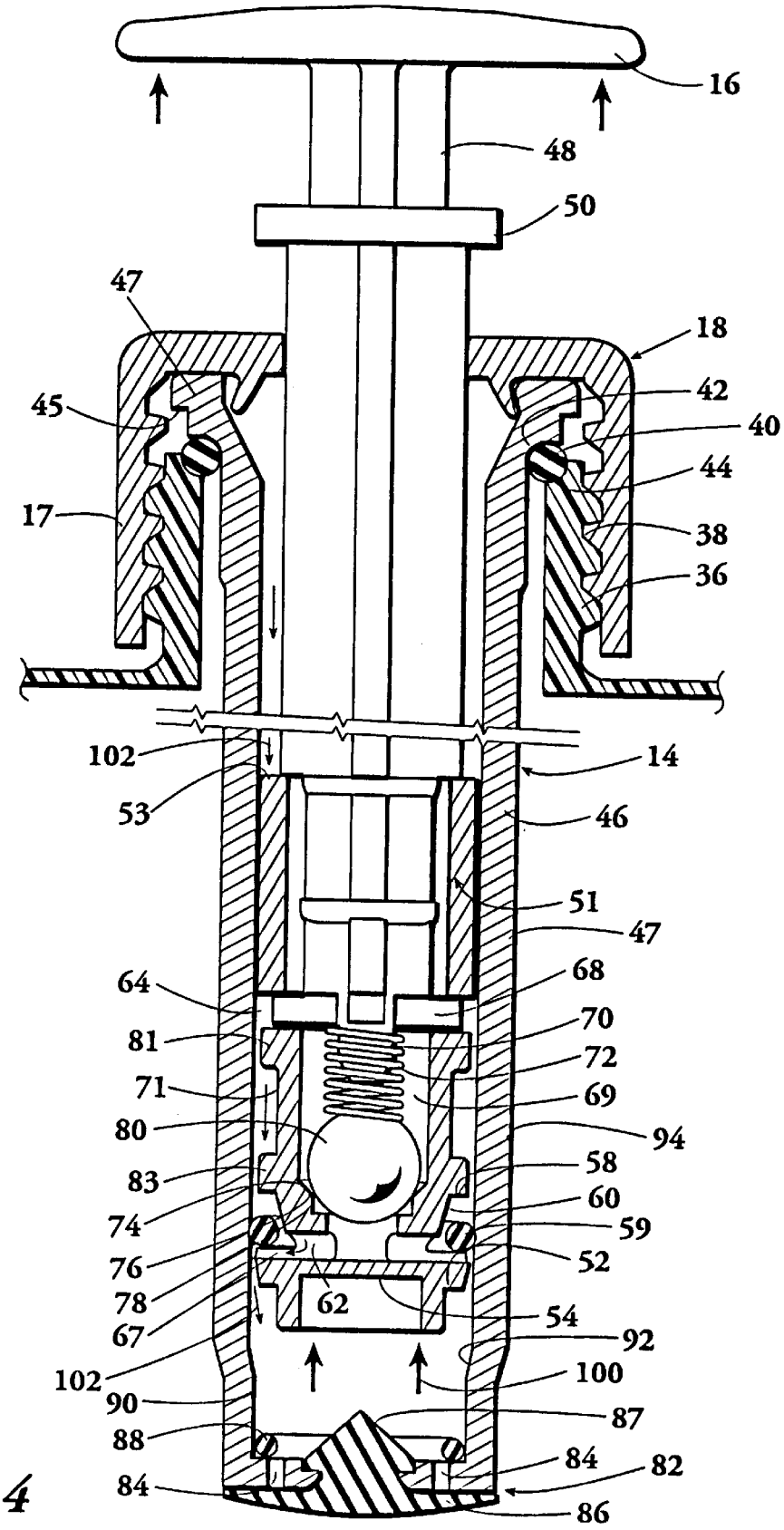
FIG. 4 is similar to FIG. 3 except that the pump handle has lifted the piston from its position of FIG. 3.
Figure 5:
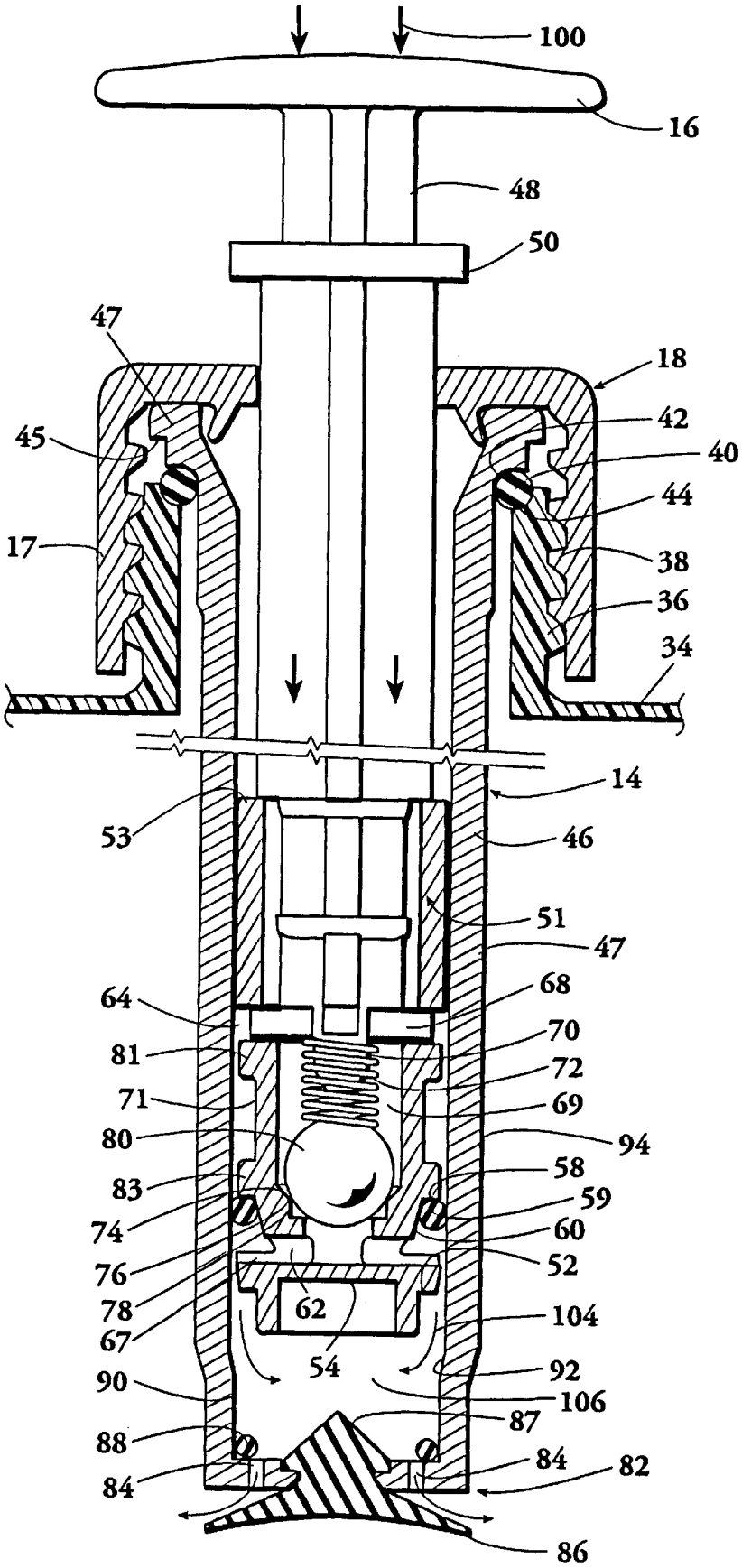
FIG. 5 is similar to FIG. 4 except that the handle is being depressed, compressing air.
Figure 7:
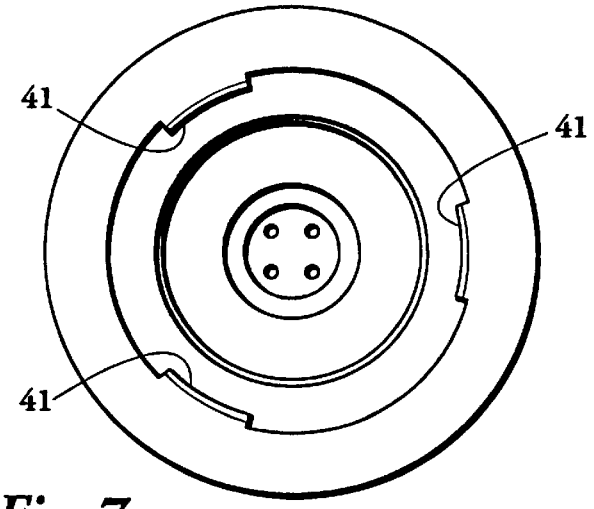
FIG. 7 is a top view of FIG. 6.

Having described the principal elements and components of the overall pressure sprayer system, attention will now be directed towards this operation in slightly more details than was previously done. When it is desired to operate this pump, tab 32 is broken as described above. Also the wand hose is then inserted and secured in the tank or bottle 10. The next step is to pull the plunger 48 upwardly. The up stroke of the plunger is shown in FIG. 4. The heavy lined arrows 100 shows that the plunger is being pulled upwardly. When this happens, two things occur: 1) The lower O-ring 88 is freed when the pump piston 50 is pulled up where disk 52 is in the larger area of the piston cylinder 46 having a diameter $D_1$. 2) The O-ring 88 which has a smaller diameter $D_2$ will then drop down and eventually reach the position shown in FIG. 4. This effectively releases the transitory seal. Thus the O-ring seal is not now effective. During this upward movement, air flows downwardly as indicated by the fine lined arrows 102. The air must flow below the pump seal 59 so that it can be compressed on the down stroke. The air follows fine lined arrows 102 which includes flowing between the plunger 48 and the interior wall of the housing 46. The air continues to flow downwardly between the interior wall of the housing 46 and the annular lugs 81 and 83 of the piston 51. The air then flows through passage 62 and 67 downwardly between the periphery of the disk 54 and interior of the cylinder 46. It is seen clearly that there is provided a path when the plunger is pulled upwardly so that the air will be permitted to flow to the space beneath the pump plunger. On the down stroke, as indicated by the heavy lined arrows 100 in FIG. 5, the O-ring 59 which has been carried upwardly by the disk 54 is held by friction at its uppermost position when the piston movement is reversed. It is then caught on the downward movement of the piston by shoulders 58, thus forming a seal as shown in FIG. 5. The distance between the disk 54 and the shoulders 58 is rather small so there is nearly a full stroke of power pressure creating the air flow which follows the fine lined arrows 104 of FIG. 5. Air flows primarily between the space 106 and out through ports 84 which when under pressure forces the flexible disk 86 of check valve 82 to open, thus permitting the air to flow outwardly under pressure.

The device is now ready to be pumped a sufficient number of times, e.g. 10–15 to maintain the desired pressure. It will be noted that the device cannot be overpressured because of the safety relief valve 80. Once the desired pressure is reached as can be determined by the number of strokes, the wand is then directed at the vegetation to be treated, and button 24 is depressed so as to allow fluid to begin to flow.

What has just been described is an efficient, inexpensive pressure sprayer unit for use in spraying primarily unwanted vegetation. It is far superior to the old finger pump mechanical pump operation. Use of this device is not messy, and it can be refilled up to five times, depending upon the nature of the fluid and the material of the container 10. When its use is over, it can be disposed of in an acceptable manner. Thus there has been developed a novel, handy, disposable type pressure pump for treating vegetation, primarily unwanted weeds and the like, although it can be used to spray protective or helpful liquid onto desired vegetation.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A pressure pump unit comprising:

a pressure vessel having at least a first opening;

a pump hosing inserted into said vessel through said first opening;

a pressure pump having a piston with a space above it capable of reciprocating within said housing and a valve assembly at its lower end, a wand attached to said vessel;

a liquid within said vessel;

a locking tab to prevent reciprocation of said pump within said housing an o-ring lodged between said valve assembly and said pump housing such that when said locking tab is removed and-said pump reciprocated sad o-ring is dislodged from said valve assembly said locking tab and said o-ring operating to maintain said liquid in said vessel and exterior of the space above the piston of said pressure pump during transportation thereof.

2. A pump unit as defined in claim 1 in which the vessel includes a hollow handle the interior of which is in fluid communication with the interior of the vessel wherein said vessel including said handle are capable of withstanding internal pressure of at least 15 psi.

3. A pump unit as defined in claim 2 in which the vessel is non-round.

4. A pump unit as defined in claim 1 in which the wand includes a flexible tubing at least partially insertable in said vessel and in sealing relationship therewith, and a wand valve unit including a pinch valve in contact with said tubing and having a handle, a depression bar contacting said pinch valve such that when in one position the pinch valve crimps the tubing just inside the wall of the handle and the flow of fluid is restricted and when in a second position flow is permitted;

a biasing means urging said valve toward said tubing;

stop means for holding said depression bar in a position holding said biasing means in a compressed state.

5. A pressure pump unit, comprising:

a non-round pressure vessel having at least a first opening;

a liquid within said vessel;

said vessel including a hollow handle the interior of which is in fluid communication with the interior of the vessel wherein said vessel and said handle are capable of withstanding internal pressure of at least 15 psi.;

a pressure pump having a housing and a piston within said housing such that a space exists above said piston within said housing;

said piston capable of reciprocation within said housing;

said pressure pump including a valve assembly at its lower end;

said housing inserted into said vessel through said first opening;

a locking tab to prevent reciprocation of said pressure pump within said housing;

an o-ring lodged between said valve assembly and said pump housing such that when said locking tab is removed and said pump reciprocated, said o-ring is dislodged from said valve assembly;

said locking tab and said o-ring operating to maintain said liquid in said vessel and exterior of the space above the piston of said pressure pump during transportation thereof.

6. A pressure pump as defined in claim 5 including a wand which includes a flexible tubing at least partially insertable in said vessel and in sealing relationship therewith, and a wand valve unit including a punch valve in contact with said tubing and having a handle, a depression bar contracting said pinch valve such that when in one position the pinch valve crimps the tubing just inside the wall of the handle and the flow of fluid is restricted and when in a second position flow is permitted;

a spring urging said valve toward said tubing;

a stop holding said depression bar in a position holding said spring in a compressed state.

7. A pressure pump unit, comprising:

a non-round pressure vessel having at least a first opening;

a liquid within said vessel;

said vessel including a hollow handle the interior of which is in fluid communication with the interior of the vessel and containing at least some of said liquid;

a pump housing sealingly insertable in said opening;

a plunger for reciprocating within said housing with an upstroke and a downstroke;

a pump piston at the lower end of said plunger, said piston having a bottom closure having a seal sealing the piston and the inner wall of said housing when said piston is on a downstroke but becoming unsealed on the upstroke of said piston;

said housing having an upper section and a lower section of a small diameter than said upper section;

said bottom closure including an O-ring of a size to seal in said lower section of said housing but not in the upper section.

8. A pressure pump as defined in claim 7 wherein a space exists above said piston within said housing and means for sealing the vessel to maintain said liquid in said vessel and exterior of the space above the piston of said pressure pump during transportation thereof.

9. A pressure pump as defined in claim 8 in which said means to seal includes a locking tab preventing reciprocation of said pump piston within said housing until said tab is broken.

10. A pressure pump as defined in claim 7 including a wand which includes a flexible tubing at least partially insertable in said vessel and in sealing relationship therewith, and a wand valve unit including a punch valve in contact with said tubing and having a handle, a depression bar contracting said pinch valve such that when in one position the pinch valve crimps the tubing just inside the wall of the handle and the flow of fluid is restricted and when in a second position flow is permitted;

a spring urging said valve toward said tubing;

a stop holding said depression bar in a position holding said spring in a compressed state.

* * * * *